United States Patent [19]

Allen et al.

[11] Patent Number: 4,706,032

[45] Date of Patent: Nov. 10, 1987

[54] TONER CONCENTRATION MONITOR

[75] Inventors: James D. Allen; David M. McVay, both of Rochester, N.Y.

[73] Assignee: Eastman Kodak Company, Rochester, N.Y.

[21] Appl. No.: 840,368

[22] Filed: Mar. 17, 1986

[51] Int. Cl.[4] ..... B05C 11/00; G03G 15/02

[52] U.S. Cl. ..... 328/1; 118/689; 355/14 D; 324/61 R; 377/12; 73/304 C; 307/602

[58] Field of Search ..... 328/1; 118/689; 355/140; 324/61 R; 377/12; 73/304 C; 307/602

[56] References Cited

U.S. PATENT DOCUMENTS

| | | | |
|---|---|---|---|
| 3,233,781 | 2/1966 | Grubbs | 222/57 |
| 3,566,259 | 2/1971 | Wilson | 324/61 R |
| 3,715,656 | 2/1973 | Hyde et al. | 324/61 R |
| 3,724,474 | 4/1973 | DeVale | 324/61 R |
| 3,779,204 | 12/1973 | Altmann | 118/668 |
| 3,897,798 | 8/1975 | DeVale | 324/61 R |
| 3,926,337 | 12/1975 | O'Neill et al. | 222/1 |
| 3,970,036 | 7/1976 | Baer et al. | 118/688 |
| 3,986,110 | 10/1976 | Overall et al. | 324/61 R |
| 3,999,119 | 12/1976 | Bares | 324/454 |
| 4,065,715 | 12/1977 | Jaffe et al. | 324/60 D |
| 4,099,118 | 7/1978 | Franklin et al. | 324/61 R |
| 4,199,984 | 4/1980 | Huddart et al. | 324/61 R |
| 4,257,348 | 3/1981 | Prohaska | 118/689 |
| 4,282,480 | 4/1981 | Fujito et al. | 324/61 R |
| 4,296,630 | 10/1981 | Jung et al. | 73/304 C |
| 4,357,901 | 11/1982 | Fagen, Jr. et al. | 118/689 |
| 4,452,174 | 6/1984 | Fedder | 118/689 |

*Primary Examiner*—John S. Heyman

*Attorney, Agent, or Firm*—Milton S. Sales

[57] ABSTRACT

A toner concentration monitor senses changes in the effective dielectric constant of a developer mixture whose dielectric constant changes with variations in the toner concentration in the mixture. The monitor is the type having a capacitive probe immersible in developer mixture such that the capacitance value of said probe varies with the effective dielectric constant of the mixture. Means are provided for creating an electrical pulse train signal of predetermined frequency and variable pulse width. The pulse width is adjusted in response to the capacitance value of the probe. The pulses are created by a multivibrator circuit which is turned on by clock pulses and which has a time constant determined by the capacitance value of the probe. Each pulse has a first portion of fixed duration and a second portion of duration variable with the capacitance value of said probe. Means may be provided for attenuating the duration of said first portion relative to said second portion so as to increase the percent of the total pulse attributable to the second portion.

6 Claims, 6 Drawing Figures

TONER CONCENTRATION MONITOR

BACKGROUND OF THE INVENTION

1. Field of the Invention

This invention relates to electrographic development apparatus for controlling the concentration of electroscopic toner particles in an electrographic developer mixture. More specifically, this invention relates to improvements in toner concentration monitoring apparatus of the type which senses toner concentration by sensing variations in the dielectric constant of the developer mixture.

2. Description of the Prior Art

In the electrographic reproduction process, the surface of a dielectric member, generally comprising a layer of photoconductive material disposed on a conductive backing, is given a uniform electrostatic charge and is then imagewise exposed to a pattern corresponding to the indicia on a document or the like being reproduced. Such exposure serves to selectively dissipate the uniform charge on the surface, leaving behind a latent electrostatic image which can then be developed by contacting it with an electrographic developer mixture.

In general, electrographic developer mixtures comprise suitably pigmented or dyed resin-based electroscopic particles, known as toner, and a granular carrier material which functions to carry such toner by generating triboelectric charges thereon. Upon contacting the electrostatic image-bearing surface, the toner particles, being charged to a polarity opposite to that of the electrostatic image, are separated from the carrier particles and are selectively deposited on the surface to form a toned image which may thereafter be transferred to a paper receiving sheet and fixed thereto by any suitable means, such as heat, to form a copy of the original document.

As toned images are repetitively formed, toner particles are depleted from the developer mixture, requiring subsequent replenishment to avoid a gradual reduction in image density. A variety of devices have been heretofore proposed for automatically replenishing toner particles after a predetermined number of copies are made, or alternatively, after a drop in the concentration of toner particles in the developer mixture below a predetermined level has been detected.

One device for detecting such a drop in toner concentration, which is disclosed in U.S. Pat. No. 3,233,781, issued to W. J. Grubbs, utilizes the difference in reflectivity exhibited by toner and carrier particles as means for monitoring the concentration of toner particles in the developer mixture. However, such optical devices have not proven entirely satisfactory in operation, especially over extended periods of time. A principal cause of unsatisfactory performance is the collection of airborne toner particles on the external surface of the various components of the monitoring apparatus, including the lamp, thereby gradually reducing the quantity of light received by the light sensing means. The low level of received energy causes the sensor to produce a false signal indicating a different concentration of toner than is actually present in the mixture. To assure freedom from erroneous measurements of this type, such monitoring apparatus requires frequent cleaning maintenance. Other causes of difficulty can be attributed to the instabilities, low output, and short life of the incandescent lamp used for illuminating the developer mixture. Another source of error in such apparatus is the random electrical perturbations, commonly called "noise," which are received and generated by the light sensing means.

Employment of the electrical properties of a developer mixture to monitor the suitability of the toner concentration overcomes the inherent deficiencies encountered in optical surveillance. For example, the dielectric constants for toner and carrier particles generally are not equal. Therefore, a change in the toner concentration in the mixture causes associated changes in the effective dielectric constant thereof. Toner concentration monitors which make use of the effective dielectric constant have been proposed. See, for example, U.S. Pat. No. 3,926,337, wherein a pair of electrically separated electrodes establish a field occupied by a developer mixture. Variations in the toner concentration within the developer mixture are indicated, in response to variations in the dielectric constant of the mixture, by an impedance bridge or Q-meter. While such indicating devices may be adequate for certain application, sensitivity is not high enough to provide a useful signal range for small changes in capacitance.

SUMMARY OF THE INVENTION

In accordance with the present invention, a novel toner concentration monitor is provided for sensing changes in the effective dielectric constant of a developer mixture whose dielectric constant changes with variations in the toner concentration in the mixture. The monitor is the type having a capacitive probe immersible in developer mixture such that the capacitance value of said probe varies with the effective dielectric constant of the mixture. Means are provided for creating an electrical pulse train signal of a predetermined frequency and a pulse width variable in response to changes in the capacitance value of the probe.

In one preferred embodiment of the invention, the pulses are created by a multivibrator circuit which is turned on by clock pulses and which has a time constant determined by the capacitance value of the probe.

In accordance with another preferred embodiment of the present invention, each pulse of the pulse train has a first portion of fixed duration and a second portion of duration variable with the capacitance value of the probe. Means are provided for attenuating the duration of said first portion relative to said second portion so as to increase the percent of the total pulse attributable to the second portion. The attenuating means is preferably a charge pump for quickly charging the capacitance probe during the duration of the first portion of each pulse. The charge pump may include a second multivibrator circuit which is turned on by the clock pulses, has a short time constant relative to the first multivibrator circuit, and has its output adapted to charge the capacitance probe.

The invention, and its objects and advantages, will become more apparent in the detailed description of the preferred embodiment presented below.

BRIEF DESCRIPTION OF THE DRAWINGS

In the detailed description of the prefered embodiments of the invention presented below, reference is made to the accompanying drawings in which.

DETAILED DESCRIPTION OF THE PREFERRED EMBODIMENTS

To assist the understanding of the present invention, the operation of an electographic copying machine in which the invention may be used will be briefly described. It is to be understood, however, that the apparatus in accordance with the present invention could be used with equal facility and advantage in other machines, and, therefore, the following description of apparatus related to, but not forming part of, the invention is provided for illustrative purposes only.

Electrographic Copying Machine

Figure 1:
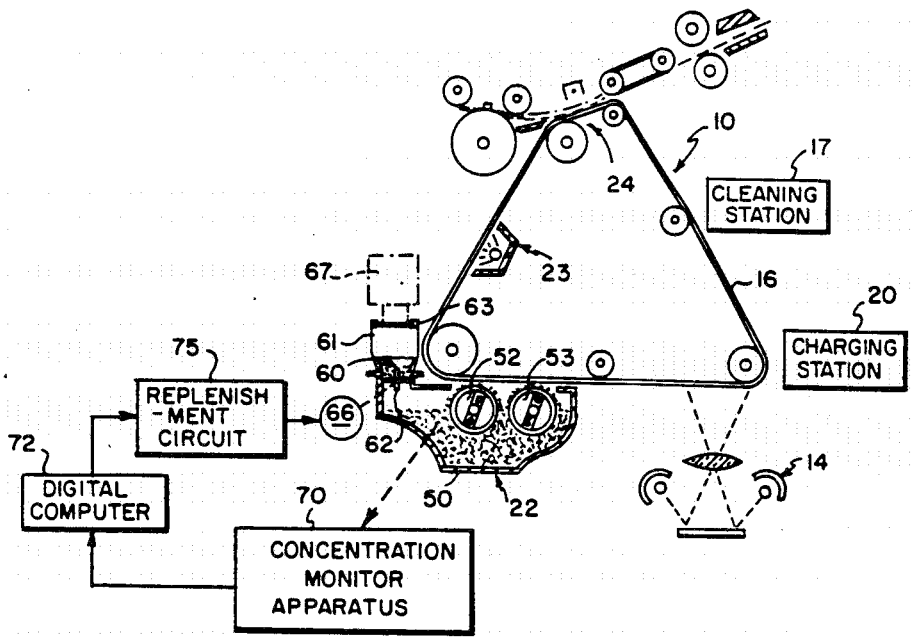
FIG. 1 is a schematic representation of an electrographic copying machine having a toner concentration monitor according to the present invention.

With reference to FIG. 1, there is shown an electrographic copying machine 10 having an image transfer dielectric member in the form of a photoconductive belt 16. The belt moves in a clockwise direction, as illustrated, along a closed path adjacent to a cleaning station 17, a charging station 20, an exposure station 14, a development station 22, a post development erase station 23, and a transfer station 24.

Development station 22 includes a developer mixture trough 50 and a pair of magnetic development brushes 52 and 53. An example of a magnetic development station 22 is more fully disclosed in commonly assigned U.S. Pat. No. 3,543,720 to Drexler et al. For an example of a developer mixture, see commonly assigned U.S. Pat. No. 3,938,992, entitled, Electographic Developing Composition and Process Using a Fusible, Cross Linked Binder Polymer to Jadwin et al, dated Feb. 17, 1976.

A conventional toner replenisher 60 is activated by a toner concentration monitor (to be described) to maintain the concentration of toner within a range required for high quality copies. Replenisher 60 includes a hopper 61 having an opening in which is dispoesd a paddle wheel 62 driven by a motor 66. An example of a conventional toner replenisher is set forth in U.S. Pat. No. 3,409,901. An interface mechanism 63 on the top of hopper 61 receives a replaceable toner container 67. An example of toner container 67 and interface mechanism 63 is set forth in detail in commonly assigned U.S. Pat. No. 4,062,385 to Katusha et al.

Toner Concentration Monitor

The toner and carrier particles in the developer mixture commonly have different dielectric constants. As shown in FIG. 1, there is provided a concentration monitor 70 which, by means of a capacitance probe in trough 50, senses the concentration of toner in the developer mixture, and emits an appropriate signal to a digital computer 72. If the computer determines toner is to be added to the mixture in response to the signal, the computer provides an output signal to a replenishment circuit 75 which in turn energizes the replenishment motor 66. The circuit 75 will continue to receive these output signals until computer 74 determines that the toner concentration is back within a desired range.

Figure 2:
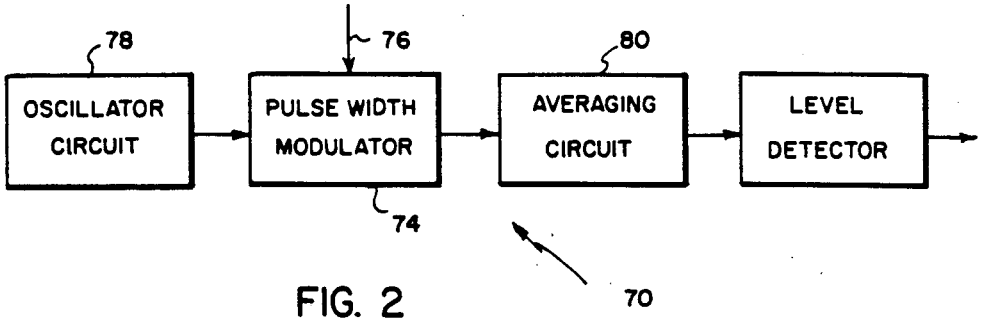
FIG. 2 is a schematic illustration showing the functions of portions of a toner concentration monitor according to the present invention.

The operation of toner concentration monitor 70 have been schematically illustrated in FIG. 2. A change in probe capacitance signal, which is indicative of the change in toner concentration in the developer mixture, is applied to a pulse width modulator 74 along an input 76. A clock pulse from an oscillator circuit 78 is also applied to the pulse width modulator to set the frequency of the system. The output of modulator 74 is a series of pulses, the width of each pulse being a function of the instantaneous capacitance of the probe due to the effective dielectric constant of the developer mixture. The modulated pulses are averaged by a circuit 80 to obtain a d.c. (or RMS) voltage which is proportional to the toner concentration in the developer mixture.

Figure 3:
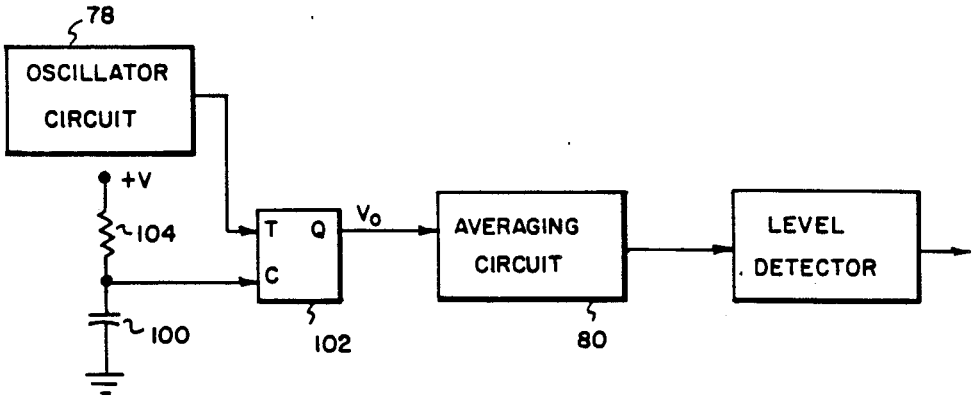
FIG. 3 is a schematic representation of a toner concentration monitor according to an embodiment of the present invention.

FIG. 3 shows one preferred embodiment of toner concentrator monitor 70 in somewhat more detail. The capacitance of the probe within trough 50 is represented by capacitor 100, and is connected to a terminal "C" of a one-shot (also known as monostable) multivibrator circuit 102. One type of multivibrator circuit 102 suitable for use in the circuit of FIG. 3 is the model MC 14538 manufactured by Motorola, Inc. Oscillator circuit 78 is connected to trigger multivibrator circuit 102 at a predetermined clock frequency.

Figure 4:
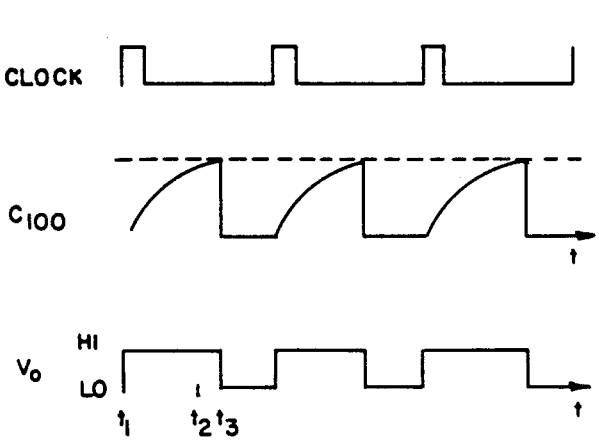
FIG. 4 is a timing diagram for the monitor of FIG. 3.

Referring also to FIG. 4, the output $V_o$ at terminal "Q" of the multivibrator circuit is set high every time the rising edge of a clock pulse is applied to terminal "T" from oscillator circuit 78 (time $t_1$). As capacitor 100 charges through resistor 104, the output $V_o$ remains high until the voltage across the capacitor reaches a predetermined threshold value (the broken line in FIG. 4), whereupon the output $V_o$ of the multivibrator circuit goes low for the rest of the clock cycle. Simultaneously with $V_o$ going low, a discharge transistor (not shown) in multivibrator circuit 102 also goes low, causing capacitor 100 to remain at near zero volts until triggered again. The total time duration that the output $V_o$ stays high, therefore, is related directly to the charging rate of capacitor 100, which in turn depends on the value of resistor 104 and the effective dielectric constant of the developer mixture.

The effective dielectric constants for toner and carrier are about 1.1 and 3.8, respectively. The range of interest in their relative concentrations by mass is about 8% to 16%. A 1% change in concentration yields only about 1% change in the value of capacitor 100. Accordingly, a change in the developer mixture concentration has very little effect on the length of time that output $V_o$ stays high. In fact, the total change in the pulse width of the output $V_o$ of multivibrator 104 due to a 1% change in the concentration is only 1%. In FIG. 4, the variable portion of the $V_o$ waveform is greatly expanded for clarity and is represented by time interval $t_3-t_2$.

Since the time interval between $t_1$ and $t_2$ is constant, it is entirely predictable and contains no useful information. If the output $V_o$ at terminal "Q" could be kept low except during the period of interest $t_2$ to $t_3$, the resultant percentage change in pulse width of that signal to a change in developer mixture toner concentration would be much greater, thereby increasing the sensitivity of the toner concentration monitor. To accomplish this, we have provided the embodiment of the present invention shown in FIG. 5.

Figure 5:
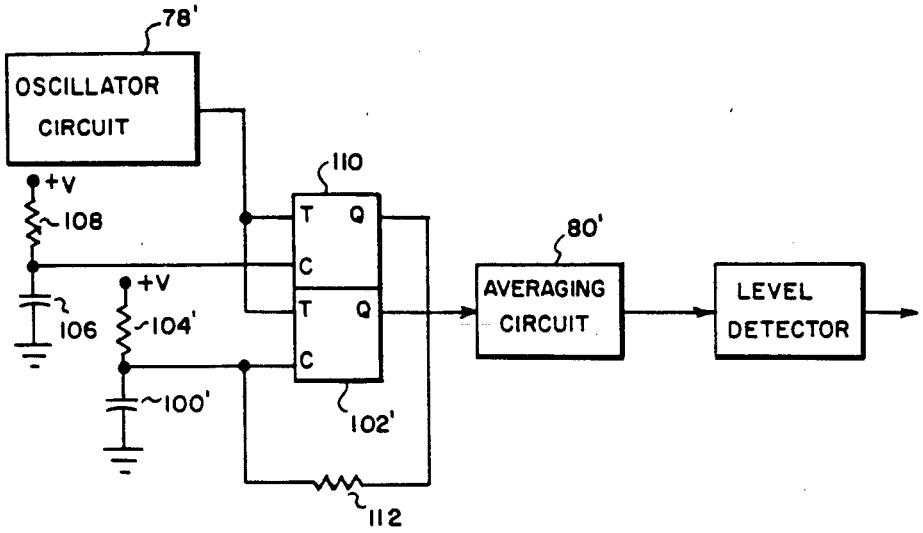
FIG. 5 is a schematic representation of another embodiment of a toner concentration monitor according to the present invention.
Figure 6:
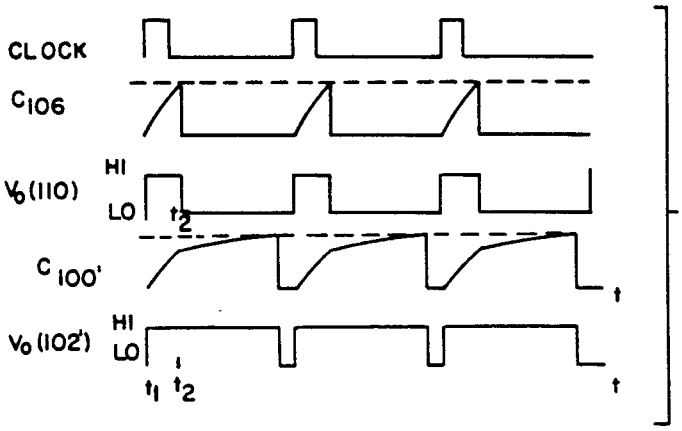
FIG. 6 is a timing diagram for the monitor of FIG. 5.

Referring now to FIGS. 5 and 6, numerals 78', 100', 102' and 104' refer to the same elements as numerals 78, 100, 102, and 104, respectively, of FIG. 3. A capacitor 106 and resistor 108 are connected to a terminal "C" of a second one-shot multivibrator circuit 110. The circuitry associated with multivibrator circuit 110 functions as a charge pump, feeding current through a current-controlling resistor 112 to probe capacitor 100'. Capacitor 106 may physically be part of probe 100 in order to match thermal characteristics of the capacitors. Of course, capacitor 106 would not be exposed to the developer mixture.

Now, referring also to FIG. 6, the outputs of multivibrator circuits 102' and 110 are set high every time the rising edge of a clock pulse is applied to terminals "T" from oscillator circuit 78' (time $t_1$). Capacitor 106 charges very quickly because relatively low value of resistor 108, and at time $t_2$, the output of multivibrator circuit 110 goes low. However, in the short time that multivibrator circuit 110 is high, it is pumping charge into probe capacitor 100' to charge that capacitor very quickly to a value just below the range of interest which would indicate the developer mixture concentrations. Thus, that portion of the clock cycle which is predictable and contains no useful information has been reduced from say 80% of the period in the FIG. 3 embodiment to only say 10% of the period in the FIG. 5 embodiment. The time scale of FIGS. 4 and 6 are representative, and are not to be considered typical of apparatus in accordance with the present invention.

After time $t_2$, the continued rate of charging of capacitor 100' is determined by the dielectric constant of the developer mixture. That capacitor charges slowly through resistor 104', which has a value of say ten times that of resistor 108. The output of multivibrator circuit 102' remains high until the charge on capacitor 100' reaches a predetermined threshold value (the broken line in FIG. 6), whereupon the output of the multivibrator circuit goes low for the rest of the clock pulse. The total time duration of the output of multivibrator circuit 102' stays high, therefore, is related directly to the values of resistor 104' and capacitor 100'.

Comparing the circuits of FIGS. 3 and 5 with typical component values, a 1% change in value of capacitor 100 of FIG. 3 would result in only say a 1% change in the pulse width of multivibrator circuit 102, while a similar 1% change in the value of capcitor 100' of FIG. 5 would result in say a 12% change in the pulse width of multivibrator circuit 102'. That is, precharging the capacitance probe with a time controlled charge pump increases the useful signal range for small changes in capacitance.

This invention has been described in detail with particular reference to a preferred embodiment thereof, but it will be understood that variations and modifications can be effected within the spirit and scope of the invention. For example, it will be apparent that the percent concentration to output pulse width can be adjusted through timing and charging rate changes, that a multivibrator circuit is only one convenient example of circuit means for adjusting the pulse width in response to capacitance changes and that the charge pump used to precharge capacitor 102' in FIG. 5 may be formed by means other than a multivibrator circuit.

We claim:

1. In a toner concentration monitor having a capacitance probe immersible in developer mixture for sensing changes in the effective dielectric constant of a developer mixture whose dielectric constant changes with variations in the toner concentration in the mixture; the improvement comprising means for generating an electrical signal comprising a series of pulses of predetermined frequency and a pulse width variable in response to the changes in the effective dielectic constant of the developer mixture such that each pulse has a first portion of fixed duration during which the capacitance probe charges at a fast rate and a second portion of duration variable with the effective dielectric constant of the developer mixture during which the capacitance probe charges at a slow rate; and means for attenuating the duration of said first portion relative to said second portion so as to increase the percentage of the pulse attributable to the second portion.

2. The improvement as defined in claim 1 said electrical signal generating means comprises:

a source of clock pulses at said predetermined frequency; and a multivibrator circuit turned on by said clock pulses and having a time constant, said capacitance probe being connected to said multivibrator circuit such that the time constant of said multivibrator circuit is determined by the effective dielectric constant of the developer mixture.

3. The improvement as defined in claim 2 wherein said attenuating means comprises a charge pump means for quickly charging said capacitance probe during said first portion of each pulse.

4. The improvement as defined in claim 3 wherein said charge pump means comprises a second multivibrator circuit (1) turned on by said clock pulses, (2) having a short time constant relative to the time constant of said first multivibrator circuit, and (3) having its output adapted to charge said capacitance probe.

5. A method for measuring the relative concentrations of a mixture of at least two types of particles having different dielectric constant characteristics comprising the steps of:

placing a capacitive probe into the mixture to create a first signal variable with the effective dielectric constant of the mixture;

generating a second signal having a pulse train of predetermined frequency and variable pulse width, each pulse being devisable into (1) a first portion of duration fixed from pulse to pulse during which the capacitance probe charges at a fast rate and (2) a second portion of duration variable with said first signal during which the capacitance probe charges at a slow rate; and attenuating the duration of said first portion relative to said second portion so as for each pulse to increase the percentage which is attributable to the second portion.

6. The method defined in claim 5 further comprising the step of converting said second signal to a voltage related to the width of the pulses of said pulse train.

* * * * *